US005464550A

United States Patent [19]

Sasaki et al.

[11] Patent Number: 5,464,550

[45] Date of Patent: Nov. 7, 1995

[54] REFRIGERATOR OIL COMPOSITION CONTAINING PHOSPHATE ESTER ADDITIVES FOR FLUOROALKANE REFRIGERANT

[75] Inventors: Umekichi Sasaki; Hiroshi Hasegawa; Yuji Shimomura, all of Kanagawa, Japan

[73] Assignee: Nippon Oil Company, Limited, Japan

[21] Appl. No.: 347,103

[22] Filed: Nov. 22, 1994

Related U.S. Application Data

[63] Continuation of Ser. No. 19,648, Feb. 19, 1993, abandoned.

[30] Foreign Application Priority Data

Feb. 20, 1992 [JP] Japan ..... 4-033535

[51] Int. Cl.[6] ..... C09K 5/04; C10M 153/00; C10M 157/08

[52] U.S. Cl. ..... 252/68; 252/49.8; 252/49.9; 252/67

[58] Field of Search ..... 252/68, 67, 49.8, 252/49.9

[56] References Cited

U.S. PATENT DOCUMENTS

| | | | |
|---|---|---|---|
| 4,851,144 | 7/1989 | McGraw et al. | 252/52 A |
| 4,948,525 | 8/1990 | Sasaki et al. | 252/52 A |
| 5,405,546 | 4/1995 | Jolley et al. | 252/68 |

FOREIGN PATENT DOCUMENTS

| | | |
|---|---|---|
| 0460614 | 12/1991 | European Pat. Off. . |
| 046614 | 12/1991 | European Pat. Off. . |
| 0470788 | 2/1992 | European Pat. Off. . |
| 0485979 | 5/1992 | European Pat. Off. . |
| 0384724 | 8/1990 | Japan . |

*Primary Examiner*—Christine Skane

*Attorney, Agent, or Firm*—Cushman Darby & Cushman

[57] ABSTRACT

A refrigerator oil composition for a fluoroalkane refrigerant comprises a base oil composed principally of at least one oxygen-containing compound and, based on the total weight of the composition, [I] 0.5–5.0 wt. % of a phosphate ester represented by the formula (A), and [II] (a) 0.1–5.0 wt. % of a halogenated phosphate ester represented by the formula (B) and/or (b) 0.01–2.0 wt. % of an acid phosphate ester represented by the formula (C), an amine salt thereof or a combination of both the acid phosphate ester and the amine salt.

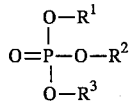

(A)

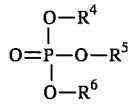

(B)

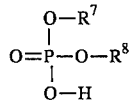

(C)

wherein $R^1$, $R^2$ and $R^3$ represent a $C_{1-18}$ hydrocarbon or oxygen-containing hydrocarbon group; $R^4$, $R^5$ and $R^6$ represent a $C_{1-18}$ hydrocarbon or oxygen-containing hydrocarbon group or a group similar to the $C_{1-18}$ hydrocarbon or oxygen-containing hydrocarbon groups except for the substitution of at least one of the hydrogen atoms by a corresponding number of halogen atom or atoms with the proviso that the total number of halogen atoms contained in $R^4$, $R^5$ and $R^6$ is 1–9; and $R^7$ and $R^8$ represent a hydrogen atom, a $C_{1-18}$ hydrocarbon or oxygen-containing hydrocarbon group.

3 Claims, No Drawings

REFRIGERATOR OIL COMPOSITION CONTAINING PHOSPHATE ESTER ADDITIVES FOR FLUOROALKANE REFRIGERANT

This is a continuation of application Ser. No. 08/019,648, filed on Feb. 19, 1993 now abandoned.

BACKGROUND OF THE INVENTION

1. Field of the Invention

The present invention relates to refrigerator oil compositions, and specifically to refrigerator oil compositions which have excellent lubricating property and are suitable for use in compression refrigerators operated using a fluoroalkane refrigerant.

2. Description of the Related Art

Refrigerator oils composed of a base oil such as a mineral oil, alkyl benzene, polyglycol or a mixture thereof and optionally added with an extreme pressure additive have heretofore been used widely in compression refrigerators which employ CFC-11, CFC-12, CFC-115, HCFC-22 or the like as a chlorine-containing refrigerant.

Among these refrigerants, CFC types including CFC-11, CFC-12 and CFC-115 are subjected to control as they are considered to lead to destruction of the ozone layer. For similar reasons, there is also a move toward controlling hydrogen-containing chlorinated hydrocarbon refrigerants such as HCFC-22. Fluoroalkane refrigerants, particularly HFC-32, HFC-125, HFC-134a and HFC-152a are similar in thermodynamic properties to CFC-12 and HCFC-22 so that they are under investigation or are being used as substitutes for Cl-containing refrigerants.

A refrigerator lubricating oil is required to satisfy a variety of properties. Of these, lubricating property is extremely important from the viewpoint of the reliability of a refrigerator system.

As lubricating oils for refrigerators cooled using a Cl-containing refrigerant such as CHF-12 or HCFC-22, there have been known lubricating oils containing, in addition to a base oil such as a mineral oil, alkylbenzene or a mixture thereof, a phosphate ester and/or a phosphite ester (Japanese Patent Laid-Open No. 91502/1979), trioleyl phosphate (Japanese Patent Laid-Open No. 86506/1976), a phosphite ester (Japanese Patent Laid-Open No. 139608/1979), tricresyl phosphate and/or triphenyl phosphite (Japanese Patent Laid-Open No. 27372/1980), a phosphate ester and a hydrogen phosphite ester (Japanese Patent Laid-Open No. 92799/1980), an organomolybdenum compound and an acid phosphate ester (Japanese Patent Laid-Open No. 75995/1984) or a thiophosphate (Japanese Patent Laid-Open No. 293286/1986).

The lubricating oils containing a phosphite ester therein, however, have the drawback that the phosphite ester reacts with water which remaining in or penetrated in a refrigerator system and forms phosphoric acid, thereby corroding metals in the system.

The lubricating oils containing a thiophosphate therein also have the drawback that thermal decomposition products of the thiophosphate corrode copper pipes in a system, windings of a motor in a hermetic-type compressor, and the like.

Chlorine atoms contained in a refrigerant molecule in a large amount in the system act as an extreme pressure additive, as have already been reported by Honma et al. in the Preprint D.9 (1989) of the 34-th National Meeting of Japan Society of Lubrication Engineers. When such conventional additives are employed in combination with a Cl-containing refrigerant such as CFC-11, CFC-12, CFC-115 or HCFC-22, their function as extreme pressure additives are not particularly important. The addition of a phosphate ester, phosphite ester, acid phosphate ester or hydrogen phosphite ester alone is sufficient.

Fluoroalkane refrigerants containing no chlorine atom or atoms in their molecules, such as HFC-32, HFC-125, HFC-134a and HFC-152a, however, have no effects as an extreme pressure additive so that the addition of an extreme pressure additive is indispensable for a lubricating oil employed in a compression refrigerators using a fluoroalkane as a refrigerant.

It is, on the other hand, important for a refrigerator oil to have good miscibility with a refrigerant. Refrigerator oils for a fluoroalkane refrigerant employ a base oil having strong polarity such as an ester oil or polyglycol oil in view of their miscibility with the refrigerant. In this case, however, strong polarity of the ester oil or polyglycol oil significantly deteriorates physical and chemical adsorption of an extreme pressure additive on a sliding metal surface, thereby lowering the effects of the extreme pressure additive so added. Further, each extreme pressure additive can act only within a certain specific temperature range so that the addition of only one extreme pressure additive is not fully effective for a commercial compressor which is operated in a wide temperature range.

U.S. Pat. No. 4,755,316 discloses a lubricating oil for refrigerators in which a fluoroalkane is used as a refrigerant. The lubricating oil comprises, as a base oil, a polyalkylene glycol and, as an extreme pressure additive, a phosphate ester, phosphite ester or thiophosphate ester. Although these extreme pressure additives have been known to date, their single use in refrigerator systems making use of a fluoroalkane as a refrigerant and a polyalkylene glycol as a lubricating oil does not allow the extreme pressure additives to fully exhibit their effects in commercial refrigerators operated in a wide temperature range no matter which extreme pressure additive is used.

SUMMARY OF THE INVENTION

An object of the present invention is to overcome the drawback, namely, the poor lubricating property of a refrigerator oil composed as a base oil of an oxygen-containing compound, such as an ester oil, neo-acid ester oil, carbonic acid ester oil and polyalkylene glycol oil and employed in combination with a fluoroalkane refrigerant and to provide a refrigerator oil composition which is useful in a refrigerant-compression type refrigerator employing a fluoroalkane as a refrigerant and shows excellent effects for the improvement of abrasion resistance.

The present inventors have proceeded with an extensive investigation on lubricating property when a fluoroalkane is used as a refrigerant and an ester oil or polyalkylene glycol oil is used as a refrigerator oil. As a result, it has been found that an abrasion-resistant and practically-usable refrigerator oil composition can be obtained by using, as an extreme pressure additive, a mixture composed of a phosphate ester as an essential component and at least two of chlorinated phosphate esters and/or acid phosphate esters or amine salts thereof, leading to the completion of the present invention.

The present invention therefore provides a refrigerator oil composition for a fluoroalkane refrigerant, said composition containing a base oil composed principally of an oxygen-containing compound, which comprises based on the total weight of the composition:

[I] 0.5–5.0 wt. % of a phosphate ester represented by the following formula (A):

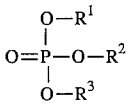

(A)

wherein $R^1$, $R^2$ and $R^3$ may be the same or different and individually represent a $C_{1-18}$ hydrocarbon or oxygen-containing hydrocarbon group; and

[II] (a) 0.1–5.0 wt. % of a halogenated phosphate ester represented by the following formula (B):

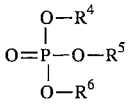

(B)

wherein $R^4$, $R^5$ and $R^6$ may be the same or different and individually represent a $C_{1-18}$ hydrocarbon or oxygen-containing hydrocarbon group or a group similar to the $C_{1-18}$ hydrocarbon or oxygen-containing hydrocarbon group except for the substitution of at least one of the hydrogen atoms by a corresponding number of halogen atom or atoms with the proviso that the total number of halogen atoms contained in $R^4$, $R^5$ and $R^6$ is 1 to 9; and/or (b) 0.01–2.0 wt. % of an acid phosphate ester represented by the following formula (C):

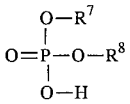

(C)

wherein $R^7$ and $R^8$ individually represent a hydrogen atom or a $C_{1-18}$ hydrocarbon or oxygen-containing hydrocarbon group with the proviso that $R^7$ and $R^8$ are not hydrogen atoms simultaneously, an amine salt thereby, or a combination of both the acid phosphate ester and the amine salt.

DETAILED DESCRIPTION OF THE PREFERRED EMBODIMENTS

The base oil contained in the refrigerator oil composition according to the present invention is composed principally of an oxygen-containing compound. Any oxygen-containing compound is usable as long as it is employed as a base oil in a refrigerator oils. Specific examples of the oxygen-containing compound include esters, polyglycols, polyphenyl ethers, silicates, polysiloxanes and perfluoroethers, which are known to those skilled in the art. Among them, esters and polyglycols are preferred.

Illustrative esters include dibasic acid esters, polyol esters, complex esters and polyol carbonate esters.

Exemplary dibasic acid esters include esters of $C_{5-10}$ dibasic acids, such as glutaric acid, adipic acid, pimelic acid, suberic acid, azelaic acid and sebacic acid, and linear- or branched-alkyl-containing $C_{1-15}$ monohydric alcohols such as methanol, ethanol, propanol, butanol, pentanol, hexanol, heptanol, octanol, nonanol, decanol, undecanol, dodecanol, tridecanol, tetradecanol and pentadecanol. Specific examples include ditridecyl glutarate, di-2-ethylhexyl adipate, diisodecyl adipate, ditridecyl adipate and di-3-ethylhexyl sebacate.

As polyol esters, esters of diols or polyols containing 3–20 OH groups and $C_{6-20}$ fatty acids can be used preferably. Preferred diols are $C_{2-12}$ diols. Specific examples of $C_{2-12}$ diols include ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol and 1,12-dodecanediol. As polyols, on the other hand, $C_{3-60}$ polyols are preferred. Specific examples include polyhydric alcohols such as trimethylolethane, trimethylolpropane, trimethylolbutane, di(trimethylolpropane), tri-(trimethylolpropane), pentaerythritol, di-(pentaerythritol), tri-(pentaerythritol), glycerin, polyglycerins (dimer to eicosamer of glycerin), 1,3,5-pentanetriol, sorbitol, sorbitane, sorbitol-glycerin condensates, adonitol, arabitol, xylitol and mannitol; saccharides such as xylose, arabinose, ribose, rhamnose, glucose, fructose, galactose, mannose, sorbose, cellobiose, maltose, isomaltose, trehalose, sucrose, raffinose, gentianose and melezitose; partially-etherified products thereof; and methyl glycoside (gycoside). Illustrative fatty acids include linear or branched fatty acids such as hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid and oleic acid; and so-called neo-acids having a quaternary α-carbon atom. These polyol esters may contain one or more free hydroxyl groups. Particularly preferred examples of polyol esters include esters of hindered alcohols such as neopentyl glycol, trimethylolethane, trimethylolpropane, trimethylolbutane, di-(trimethylolpropane), tri-(trimethylolpropane), pentaerythritol, di-(pentaerythritol) or tri-(pentaerythritol). Specific examples include trimethylolpropane caprylate, trimethylolpropane pelargonate, pentaerythritol 2-ethylhexanoate and pentaerythritol pelargonate.

The term "complex ester" as used herein means a mixture of esters of a monohydric alcohol and polyol with a fatty acid and a dibasic acid. No particular limitation is imposed on their mixing ratio. As the fatty acid, dibasic acid, monohydric alcohol and polyol, those exemplified above with respect to the dibasic acid ester and polyol ester can be used.

The polyol carbonic acid ester is an ester of a carbonic acid and a polyol. As illustrative polyols, those exemplified above with respect to the polyol ester, polyglycols obtained by homo- or co-polymerization of diols as well as those obtained by adding a polyglycol to the polyols exemplified above can be used.

Preferred examples of the polyglycol include polyalkylene glycols, etherified polyalkylene glycols and modified compounds thereof. As polyalkylene glycols, those obtained by homo- or co-polymerization of diols can be used. Usable as diols are those exemplified above with respect to the polyol ester as well as polyalkylene glycols with their hydroxyl group or groups etherified. Specific examples of these etherified polyalkylene glycols include monomethyl ether, monoethyl ether, monopropyl ether, monobutyl ether, monopentyl ether, monohexyl ether, monoheptyl ether, monooctyl ether, monnonyl ether, monodecyl ether, dimethyl ether, diethyl ether, dipropyl ether, dibutyl ether, dipentyl ether, dihexyl ether, deheptyl ether, dioctyl ether, dinonyl ether and didecyl ether. Illustrative modified compounds of polyglycols include polyol-polyalkylene-glycol condensates and etherified products thereof. In this case, the polyols exemplified above with respect to the polyol ester can be used. Incidentally, when the polyalkylene glycol has been obtained by the copolymerization of diols having different structures, no particular limitation is imposed on the manner of polymerization of oxyalkylene groups. The oxyalkylene groups may be copolymerized either at random or in blocks.

Although no particular limitation is imposed on the molecular weight of each polyglycol used in the composition of the invention, one having a number average molecular weight of 200–3,000 can be used preferably to further improve the sealing of compressors, with a polyglycol having an average molecular weight of 300–2,000 being more preferred.

The oxygen-containing compounds described above can be used either singly or in combination. The kinematic viscosity of the oxygen-containing compound in the present invention is 2–150 cSt, preferably 4–100 cSt, at 100° C.

In the composition according to the present invention, the above oxygen-containing compounds can each be used alone as a base oil. Alternatively, the oxygen-containing compound, as a main component, and optionally a mineral oil, a synthetic oil or the like which is employed in refrigerator oils for chlorine-containing refrigerants such as CFC-12 and HCFC-22 can be used in combination as a base oil. As mineral oils, paraffin mineral oils, naphthene mineral oils and the like can be used. They are obtained by subjecting a lubricating oil fraction, which has been obtained by atmospheric distillation and vacuum distillation of a crude oil, to a suitable combination of refining treatment steps such as solvent deasphalting, solvent extraction, hydrogenolysis, solvent dewaxing, catalytic dewaxing, hydrorefining, sulfuric acid treatment and clay treatment. As synthetic oils, known poly-α-olefins such as polybutene, 1-octene oligomer and 1-decene oligomer; alkylbenzenes, alkylnaphthalenes and mixtures of at least two of them are usable. In this case, it is desirable that the oxygen-containing compound is contained in an amount of at least 50 wt. %, preferably at least 70 wt. %, based on the total amount of the base oil. The preferred dynamic viscosity of the base oil ranges from 2.0 cSt to 100 cSt at 100° C.

The composition according to the present invention comprises the base oil described above and, based on the total amount of the composition:

[I] 0.5–5.0 wt. %, preferably 1.0–3.0 wt. % of a phosphate ester represented by the following formula (A):

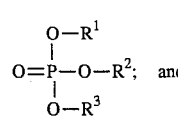

(A)

and

[II] (a) 0.1–5.0 wt. %, preferably 0.5–3.0 wt. % of a halogenated phosphate ester represented by the following formula (B):

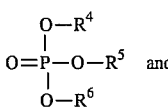

(B)

and/or (b) 0.01–2.0 wt. % preferably 0.05–10 wt. % of an acid phosphate ester represented by the following formula (C):

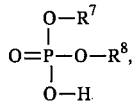

(C)

its amine salt or both of them.

If the content of each component is smaller than the above range, the resultant lubricating oil will be less effective for the improvement of abrasion resistance. Even if the content exceeds the above range, on the other hand, the resultant lubricating oil will not show improving effects in proportion to the increase in the content. Contents outside the above range, therefore, are not preferred.

$R^1$, $R^2$ and $R^3$ in the formula (A) of the phosphate ester may be the same or different and individually represent a $C_{1-18}$, preferably $C_{3-9}$ hydrocarbon or oxygen-containing hydrocarbon group. Preferred examples of the hydrocarbon group include alkyl, phenyl, cresyl and xylyl. The term "oxygen-containing hydrocarbon group" as used herein means a hydrocarbon group in which at least one of the carbon atoms has been substituted by a corresponding number of oxygen atom(s). Preferred is the group represented by the formula $—(XO)_n—R^9$ wherein X represents a $C_{2-4}$ alkylene group, $R^9$ represents a $C_{1-18}$ hydrocarbon group (preferably, an alkyl group) and n represents an integer of 1–20. Specific examples of the $C_{1-18}$ alkyl group include methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl, iso-dodecyl, n-tridecyl, iso-tridecyl, n-tetradecyl, iso-tetradecyl, n-pentadecyl, iso-pentadecyl, n-hexadecyl, iso-hexadecyl, n-heptadecyl, iso-heptadecyl, n-octadecyl and iso-octadecyl groups.

$R^4$, $R^5$ and $R^6$ in the halogenated phosphate ester represented by the formula (B) may be the same or different and individually represents a $C_{1-18}$, preferably $C_{3-9}$ hydrocarbon or oxygen-containing hydrocarbon group or a group similar to the hydrocarbon or oxygen-containing hydrocarbon group except for the substitution of at least one of the hydrogen atoms by a corresponding number of halogen atom or atoms. Preferred examples of the hydrocarbon group include, alkyl, phenyl, cresyl and xylyl. Illustrative of the $C_{1-18}$ alkyl group specifically include groups similar to those exemplified above with respect to the phosphate ester (A). In addition, as the oxygen-containing hydrocarbon group, groups similar to those described above with respect to the phosphate ester (A) can be given.

$R^4$, $R^5$ and $R^6$ should be selected so that the total number of halogen atoms contained therein amounts to 1–9, preferably, 2–6. Preferred examples of the halogen atoms include fluorine, chlorine, bromine and iodine with chlorine being particularly preferred.

$R^7$ and $R^8$ in the acid phosphate ester represented by the formula (C) individually represent a hydrogen atom, $C_{1-18}$, preferably $C_{3-9}$ hydrocarbon group, or an oxygen-containing hydrocarbon group. They are not hydrogen atoms at the same time. The preferred examples of the hydrocarbon group include alkyl, phenyl, cresyl and xylyl. As the oxygen-containing hydrocarbon group, those represented by the formula (A) with respect to the phosphate ester can be given. Specific examples of the $C_{1-18}$ alkyl group include those represented by the formula (A) with respect to the phosphate ester.

An alkylamine or alkenylamine is preferred as an amine in the amine salt of the acid phosphate ester represented by the formula (C) in [II].

As the alkylamine, a $C_{6-18}$ monoalkylamine is preferably employed. Specific examples include n-hexylamine, n-heptylamine, n-octylamine,, n-nonylamine, n-decylamine, n-undecylamine, n-dodecylamine, n-tridecylamine, n-tetradecylamine, n-pentadecylamine, n-hexadecylamine, n-heptadecylamine, n-octadecylamine, iso-hexylamine, iso-heptylamine, iso-octylamine, iso-nonylamine, iso-decylamine, iso-undecylamine, iso-dodecylamine, iso-tridecylamine, iso-tetradecylamine, iso-pentadecylamine, iso-hexadecylamine, iso-heptadecylamine and iso-octadecylamine. As the alkenylamine, on the other hand, a $C_{12-18}$ monoalkenylamine is preferably employed. Examples include 1-dodecenylamine, 1-tridecenylamine, 1-tetradecenylamine, 1-pentadecenylamine, 1-hexadecenylamine, 1-heptadecenylamine and 1-octadecenylamine.

To improve the overall performance of the refrigerator oil composition of the present invention, the composition can be added with one or more of ordinarily-used additives, for example, scavengers for acid substances and/or active substances such as free radicals, e.g., phenyl glycidyl ether, butyl phenyl-glycidyl ether, nonylphenyl glycidyl ether and epoxy compounds such as epoxylated vegetable oils; phenol-type and amine-type antioxidants; oiliness improvers such as higher alcohols and higher fatty acids; metal deactivators such as benzotriazole. These additives can be added in proportions generally employed.

Specific examples of the refrigerant usable in combination with the refrigerator oil composition of the present invention include fluoroalkane refrigerants such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a) and 1,1-difluoroethane (HFC-152a).

The refrigerator oil compositions according to the invention can be widely used in apparatuses employing a refrigerant-compression type refrigerator, such as refrigerators, freezing chambers, automatic vending machines, display cases, room air conditioners, car air conditioners, dehumidifiers and chemical plants.

When a refrigerator oil composition according to the present invention is used in such a refrigerant-compression type refrigerator as exemplified above, it is ordinarily used in the form of a fluid composition containing the above refrigerant mixed therein. No particular limitation is imposed on their mixing ratio, however, it is desirable to use, in a mixed state, 1–500 parts by weight, preferably 2–400 parts by weight of the refrigerator oil composition per 100 parts by weight of the refrigerant.

The present invention will next be described in detail by the following examples and comparative examples. It should however be borne in mind that this invention is by no means limited to or by the examples.

EXAMPLES 1–16

In order to evaluate the performance of refrigerator oil compositions of the present invention in Examples 1–16, their lubricating property was evaluated using a high-pressure atmosphere friction tester which was reported under B-S7 at the Tribology Conference held by Japan Society of Lubrication Engineers in the spring of 1991 in Tokyo. The results are shown in Table 1 (1).

For comparison, evaluation results of comparative products with which one or more extreme pressure additives had been blended in a conventional manner are also presented in Table 1 (2).

TABLE 1 (1)

| | | Base oil | Extreme pressure additive (wt. %) | Seizure load (kgf) 80° C. | Seizure load (kgf) 110° C. |
|---|---|---|---|---|---|
| Example | 1 | PE | TCP(2),CPP(1) | 450 | 430 |
| | 2 | PAG | TCP(2),CPP(1) | 410 | 400 |
| | 3 | PE | TCP(0.5),CPP(4) | 490 | 450 |
| | 4 | PE | TCP(2),CEP(1) | 420 | 410 |
| | 5 | PE | TCP(4),CEP(0.1) | 450 | 420 |
| | 6 | PE | TPP(2),EHAP(0.5) | 480 | 440 |
| | 7 | PE | TPP(2),TDAP(0.5) | 490 | 440 |
| | 8 | PE | TPP(2),OAP(0.5) | 450 | 420 |
| | 9 | PE | TPP(2),EHAP-OA(0.5) | 460 | 420 |
| | 10 | PE | TCP(2),EHAP-LA(0.5) | 450 | 410 |
| | 11 | PAG | TCP(2),EHAP-LA(0.5) | 410 | 370 |
| | 12 | PE | TCP(2),CPP(1),OAP(0.07) | 460 | 430 |
| | 13 | PE | TCP(2),CPP(1),OAP(0.5) | 480 | 440 |
| | 14 | PAG | TCP(2),CPP(1),OAP(0.5) | 420 | 380 |
| | 15 | PE | TCP(2),CPP(1),OAP(1.5) | 490 | 460 |
| | 16 | PE | TCP(2),CEP(1),TDAP(0.5) | 460 | 420 |

TABLE 1 (2)

| | | Base oil | Extreme pressure additive (wt. %) | Seizure load (kgf) 80° C. | Seizure load (kgf) 110° C. |
|---|---|---|---|---|---|
| Comparative Example | 1 | PE | — | 260 | 240 |
| | 2 | PAG | — | 350 | 230 |
| | 3 | PE | TCP(3) | 320 | 300 |
| | 4 | PAG | TCP(3) | 300 | 280 |
| | 5 | PE | CPP(3) | 350 | 360 |
| | 6 | PAG | CPP(3) | 340 | 330 |
| | 7 | PE | TDAP(0.5) | 380 | 370 |
| | 8 | PE | OAP(0.5) | 380 | 360 |
| | 9 | PAG | EHAP-OA(0.5) | 300 | 260 |
| | 10 | PAG | EHAP-LA(0.5) | 280 | 250 |
| | 11 | PE | TCP(3),CPP(0.05) | 330 | 320 |
| | 12 | PE | TCP(0.3),CPP(1), ODAP(0.5) | 370 | 350 |

PE: Pentaerythritol 2-ethylhexanoltetraester
PAG: Polyoxypropyleneglycol monobutylether
TCP: Tricresyl phosphate
TPP: Triphenyl phosphate
CPP: Tris-dichloropropyl phosphate
CEP: Tris-chloroethyl phosphate
EHAP: 2-Ethylhexyl acid phosphate
TDAP: Tridecyl acid phosphate
OAP: Oleyl acid phosphate
EHAP-OA: Oleylamine salt of 2-ethylhexylacid phosphate
ODAP: Octadecylacid phosphate
EHAP-LA: Laurylamine salt of 2-ethylhexylacid phosphate A lubricating property test using the above high-pressure atmosphere friction tester will hereinafter be described in brief.

A sample refrigerator oil (420 g) and 150 g of 1,1,1,2-tetrafluoroethane (HFC-134a) were weighed in a high-pressure metal vessel. In a state dipped in the resulting mixture, a rotating cylindrical test piece (made of S-55C cast iron) was maintained in contact with a fixed cylindrical test piece (made of SCM-3 cast iron) equipped with an oil groove. While the rotating test piece being rotated at 500 rpm, load was applied upwardly with the level of the load being increased gradually. The test was continued until seizure occurred. The lubricating property was evaluated in accordance with the load at the time when seizure occurred.

Data of lubricating oils containing a polyol ester as a base oil and TCP (a phosphate ester) or CPP (a chlorinated phosphate ester) in an amount of 3% based on the base oil are shown under Comparative Examples 2 and 3. Compared with Comparative Examples 2 and 3, mixed use of TCP as a phosphate ester and CPP as a chlorinated phosphate ester was found to improve the seizure load on the high-pressure atmosphere friction tester by as much as 1.2 to 1.5 times as demonstrated in Examples 1–4.

In addition, compared with the use of a single extreme pressure additive in Comparative Examples 6–9, the mixed use of a phosphate ester and an acid phosphate ester in Examples 5–8, the mixed use of a phosphate ester and an amine salt of an acid phosphate ester in Example 9 and the mixed use of a phosphate ester, a chlorinated phosphate ester and an acid phosphate ester in Examples 10–13 apparently showed excellent seizure load.

As can be clearly seen from Comparative Examples 11 and 12, even mixed use of TCP and CPP or mixed use of TCP, CPP and ODAP failed to bring about any sufficient effect when they were added in amounts smaller than those specified by the present invention.

The present invention makes it possible to improve the lubricating property of a refrigerator oil composition which employs an oxygen-containing compound as a base oil. This composition exhibits excellent abrasion resistance when used as a lubricating oil in a refrigerator operated using a fluoroalkane refrigerant.

What is claimed is:

1. A fluid composition for a refrigerator, which comprises 100 parts by weight of a fluoroalkane refrigerant and 1–500 parts by weight of a refrigerator oil composition, said refrigerator oil composition containing a base oil composed principally of an oxygen-containing compound selected from the group consisting of dibasic acid esters, polyol esters, polyol carbonate esters, polyglycols, and mixtures thereof, which comprises based on the total weight of the refrigerator oil composition:

0.5–5.0 wt. % of a phosphate ester represented by the following formula (A):

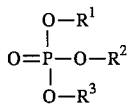

(A)

wherein $R^1$, $R^2$ and $R^3$ may be the same or different and individually represent a $C_{1-18}$ hydrocarbon; and (a) 0.1–5.0 wt. % of a chlorinated phosphate ester represented by the following formula (B):

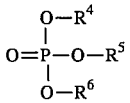

(B)

wherein $R^4$, $R^5$ and $R^6$ and may be the same or different and individually represent a $C_{1-18}$ hydrocarbon, wherein at least one of the hydrogen atoms is substituted by a corresponding number of chlorine atoms with the proviso that the total number of chlorine atoms contained in $R^4$, $R^5$, and $R^6$ and is 1 to 9; and/or (b) 0.01–2.0 wt. % of an acid phosphate ester represented by the following formula (C):

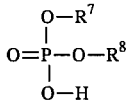

(C)

wherein $R^7$ and $R^8$ individually represent a hydrogen atom or a $C_{1-18}$ hydrocarbon, an amine salt thereby, or a combination of both the acid phosphate ester and the amine salt with the proviso that $R^7$ and $R^8$ are not hydrogen atoms simultaneously.

2. A fluid composition according to claim 1 wherein said polyglycols are polyalkylene glycols.

3. A fluid composition according to claim 1 wherein the polyglycols are etherified polyalkylene glycols.

* * * * *